US010242511B2

(12) United States Patent
Hanson et al.

(10) Patent No.: US 10,242,511 B2
(45) Date of Patent: Mar. 26, 2019

(54) USING ON-BOARD MONITORING (MODE 6) MISFIRE TESTS IN DATA STREAM AND PHYSICAL ADDRESSING

(71) Applicant: Bosch Automotive Service Solutions Inc., Warren, MI (US)

(72) Inventors: Todd Hanson, Owatonna, MN (US); Michael O'Brien, West Concord, MN (US); Dan Brase, Medford, MN (US)

(73) Assignee: Bosch Automotive Service Solutions Inc., Warren, MI (US)

( * ) Notice: Subject to any disclaimer, the term of this patent is extended or adjusted under 35 U.S.C. 154(b) by 124 days.

(21) Appl. No.: 15/393,946

(22) Filed: Dec. 29, 2016

(65) Prior Publication Data

US 2018/0190041 A1 Jul. 5, 2018

(51) Int. Cl.

| | |
|---|---|
| ***G07C 5/08*** | (2006.01) |
| ***G07C 5/00*** | (2006.01) |
| ***F02P 17/12*** | (2006.01) |

(52) U.S. Cl.

CPC ..... *G07C 5/008* (2013.01); *F02P 17/12* (2013.01); *G07C 5/0808* (2013.01); *G07C 5/0825* (2013.01); *G07C 2205/02* (2013.01)

(58) Field of Classification Search
None
See application file for complete search history.

(56) References Cited

U.S. PATENT DOCUMENTS 5,237,862 A * 8/1993 Mangrulkar ..... G01M 15/11 73/114.04
2016/0146704 A1* 5/2016 Ejakov ..... G01M 15/11 701/111

OTHER PUBLICATIONS

Warren, Mark. "Driveability Corner", see attached PDF version.*

* cited by examiner

*Primary Examiner* — Nadeem Odeh
*Assistant Examiner* — Michael V Kerrigan
(74) *Attorney, Agent, or Firm* — BakerHostetler

(57) ABSTRACT

A diagnostic tool configured to retrieve mode 6 cylinder misfire data from an engine controller using physical addressing of the engine controller. The mode 6 data is retrieved on a continuous and dynamic basis instead of a snapshot. The retrieved mode 6 data may be displayed on a GUI and may also contain other mode 6 data such as throttle position sensor, engine RPM and mass air flow.

20 Claims, 5 Drawing Sheets

USING ON-BOARD MONITORING (MODE 6) MISFIRE TESTS IN DATA STREAM AND PHYSICAL ADDRESSING

FIELD OF THE DISCLOSURE

The present disclosure relates generally to a diagnostic tool, such as a scan tool. More particularly, the present disclosure relates to a diagnostic tool that is able to use onboard monitoring misfire data and physical addressing.

BACKGROUND

Diagnostic Trouble Codes are often used by vehicle manufacturers to indicate an issue with components such as the engine of the vehicle. However, certain manufacturers such as Ford, set their parameters (minimum/maximum) for a misfire too wide of values so that a DTC for a potential or actual misfire is never set. Thus, causing difficulty to properly diagnosis a misfire is a cause of engine "sputter" or lack of power. Even when the "misfire" type data was available for Ford enhanced data using service 0x22 (request by common ID) in the pre-CAN years (i.e. FORD SCP engine systems), the "misfire data" would be hard to interpret as to which cylinder was misfiring. Starting with Ford CAN (Controller Area Network) engine systems, the "misfire" data was eliminated from the enhanced service using common ID's. Therefore, the "misfire" data was not available in CAN system type engine data streams for Ford in the Ford's enhanced data, which then frustrated the technicians.

Even when a technician can use a diagnostic tool to obtain "misfire" data of a cylinder, the "misfire" data if available is only a snapshot of cylinder firing data at that moment of time and thus, determining which cylinder or cylinders is misfiring is again difficult. For example, a misfire that occurs mainly between going from $2^{nd}$ gear to $3^{rd}$ gear of the transmission would be difficult to detect when only a one time "snapshot" of cylinders firing are shown to the technician. This is because the misfire is intermittent and thus the snapshot has to be at the right time.

In order to temper these frustrations, there is a need to be able to retrieve "misfire" data on enhanced CAN engine systems such as on a Ford and display it to the technician in order to properly diagnose the vehicle.

SUMMARY

The foregoing needs are met, to a great extent, by the present disclosure, wherein in one aspect of an apparatus is provided in some embodiments to include a diagnostic tool capable of displaying live mode 6 data in vehicles that utilizes CAN protocol.

In one embodiment, a vehicle diagnostic tool is provided and can include a diagnostic processor configured to execute computing instructions, a connector interface configured to connect with a connector in a vehicle and retrieve vehicle diagnostic data from the vehicle with the processor, wherein the vehicle diagnostic data is mode 6 cylinder misfire data, a display in communication with the processor configured to display vehicle diagnostic data, a wireless communication interface in communication with the processor and configured to communicate with a remote device having a vehicle diagnostic database, and a memory in communication with the processor, the memory containing computing instructions, that when executed by the processor causes the processor to retrieve vehicle diagnostic data including diagnostic trouble codes (DTCs) and mode 6 cylinder misfire data, the mode 6 cylinder misfire data is retrieved continuously and dynamically by using physical addressing of an engine controller in the vehicle, generate, on the display, a plurality of selectable icons corresponding to individual cylinder misfire data for each supported cylinder of the vehicle, indicate on the selectable icons a number of cylinder misfire, if any, for each supported cylinder, and activate a web browser on the remote device to start the repair process.

In another embodiment, a non-transitory machine-readable storage medium that includes machine-readable instructions for causing a processor of a diagnostic tool to execute the method of retrieving vehicle diagnostic data including diagnostic trouble codes (DTCs) and mode 6 cylinder misfire data, the mode 6 cylinder misfire data is retrieved continuously and dynamically by using physical addressing of an engine controller in the vehicle, generating, on a display of the diagnostic tool, a plurality of selectable icons corresponding to individual cylinder misfire data for each supported cylinder of the vehicle, indicating on the selectable icons a number of cylinder misfire, if any, for each supported cylinder, and activating a web browser on the remote device to start the repair process.

In still another embodiment, a vehicle diagnostic tool is provided and includes means for processing configured to execute computing instructions, means for interfacing configured to connect with a connector in a vehicle and retrieve vehicle diagnostic data from the vehicle with the means for processing, wherein the vehicle diagnostic data is mode 6 cylinder misfire data, means for displaying in communication with the means for processing configured to display vehicle diagnostic data, means for wireless communication in communication with the means for processing and configured to communicate with a remote device having a vehicle diagnostic database, and means for storing in communication with the means for processing, the memory containing instructions, that when executed by the means for processing causes the means for processing to retrieve vehicle diagnostic data including diagnostic trouble codes (DTCs) and mode 6 cylinder misfire data, the mode 6 cylinder misfire data is retrieved continuously and dynamically by using physical addressing of an engine controller in the vehicle, generate, on the means for displaying, a plurality of selectable icons corresponding to individual cylinder misfire data for each supported cylinder of the vehicle, indicate on the selectable icons a number of cylinder misfire, if any, for each supported cylinder; and activate a web browser on the remote device to start the repair process.

There has thus been outlined, rather broadly, certain embodiments of the disclosure in order that the detailed description thereof herein may be better understood, and in order for the present contribution to the art may be better appreciated. There are, of course, additional embodiments of the disclosure that will be described below and which will form the subject matter of the claims appended hereto.

In this respect, before explaining at least one embodiment of the disclosure in detail, it is to be understood that the disclosure is not limited in its application to the details of construction and to the arrangements of the components set forth in the following description or illustrated in the drawings. The disclosure is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

DETAILED DESCRIPTION

Figure 1:
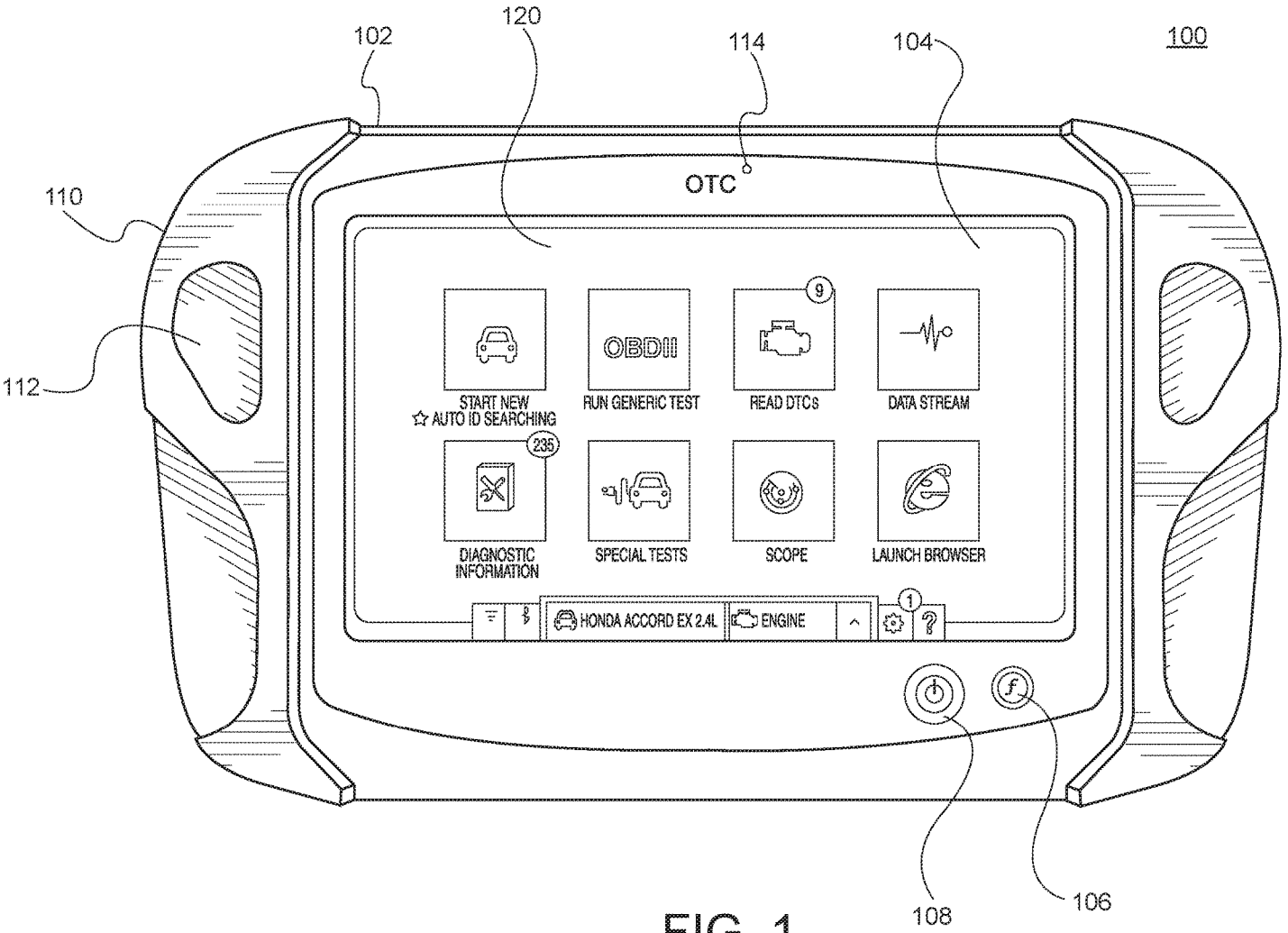
FIG. 1 depicts a front view of a diagnostic tool according to an exemplary embodiment of the present disclosure.

The disclosure will now be described with reference to the drawing figures, in which like reference numerals refer to like parts throughout. An embodiment in accordance with the present disclosure provides a computing device such as diagnostic tool, a notebook, a tablet, or a smart phone that can query a vehicle having CAN engine system for "misfire" data and then displaying it on the diagnostic tool.

FIG. 1 illustrates a front view of a diagnostic tool 100 according to an embodiment of the disclosure. An example of the diagnostic tool is the Genisys® Touch or Encore from Bosch Automotive Service Solutions, Inc. (Owatonna, Minn.). The diagnostic tool 100 may include a housing 102, a display 104, a function button or a user interface 106, a power button 108, gripping portions 110 having a finger (thumb) receiving portion 112, a camera 114 and graphical user interface 120 (discussed below). The power button 108 can also be used to put the diagnostic tool 100 into a standby mode in order to save battery power when not in use.

The gripping portions 110 may be made of a polymer including hydrogels for easy gripping. The finger-receiving portion 112 may be configured to receive a finger, such as a thumb of the user, to assist in better gripping of the diagnostic tool 100. The function button or user interface 106 may be configured for any function desired by the user including enter, back, forward, left, right, up, down, transmit, receive, return, start over, and the like. The function button can also include multiple functions of any combination of functions, such as enter and then back, etc. The user interface 106 may also include a keyboard having numbers and letters and/or be alphanumeric and the like.

The display 104 can be any type of display including a touch screen display, LCD, LED, VGA, OLED, SVGA, and other types of displays. The display 104 may be a colored, non-colored (e.g. gray scale), or a combination of both. The display 104 can display information such as the make, model, year of vehicle that the diagnostic tool 100 can diagnose, the various diagnostic tests the diagnostic tool can run, diagnostic data the diagnostic tool has received, the baseline data of the various components in a vehicle, part images, parts information, and information from remote servers (internet, database information, etc.). Additionally, the display can show videos for the user to view, and the accompanying audio can be heard via the built in speakers (not shown). The speakers can be a single speaker or multiple speakers for stereo sound. A microphone (not shown) may be included and allows the technician to record information such as the noise being made by the vehicle for later analysis or for comparison with stored data. Further, the technician can also record comments or notes during the testing for later retrieval and analysis.

In one embodiment, the display allows the user to input selection through the touch screen for interactive navigation and selection, wherein the technician can select a menu item or icons (further discussed below) by touching the selection on the graphical user interface (GUI) 120. Additionally, the display 104, when tapped or touched, can also be used to wake up the diagnostic tool 100 if it is in a sleep mode.

The camera 114 may be positioned to face the user so that the user may conduct a video chat with another person at a remote location. The camera may also be positioned on any surface of the diagnostic tool 100 including on the opposite side of display 104 so that images of parts of an engine or any components desired by the user can be taken.

Figure 2:
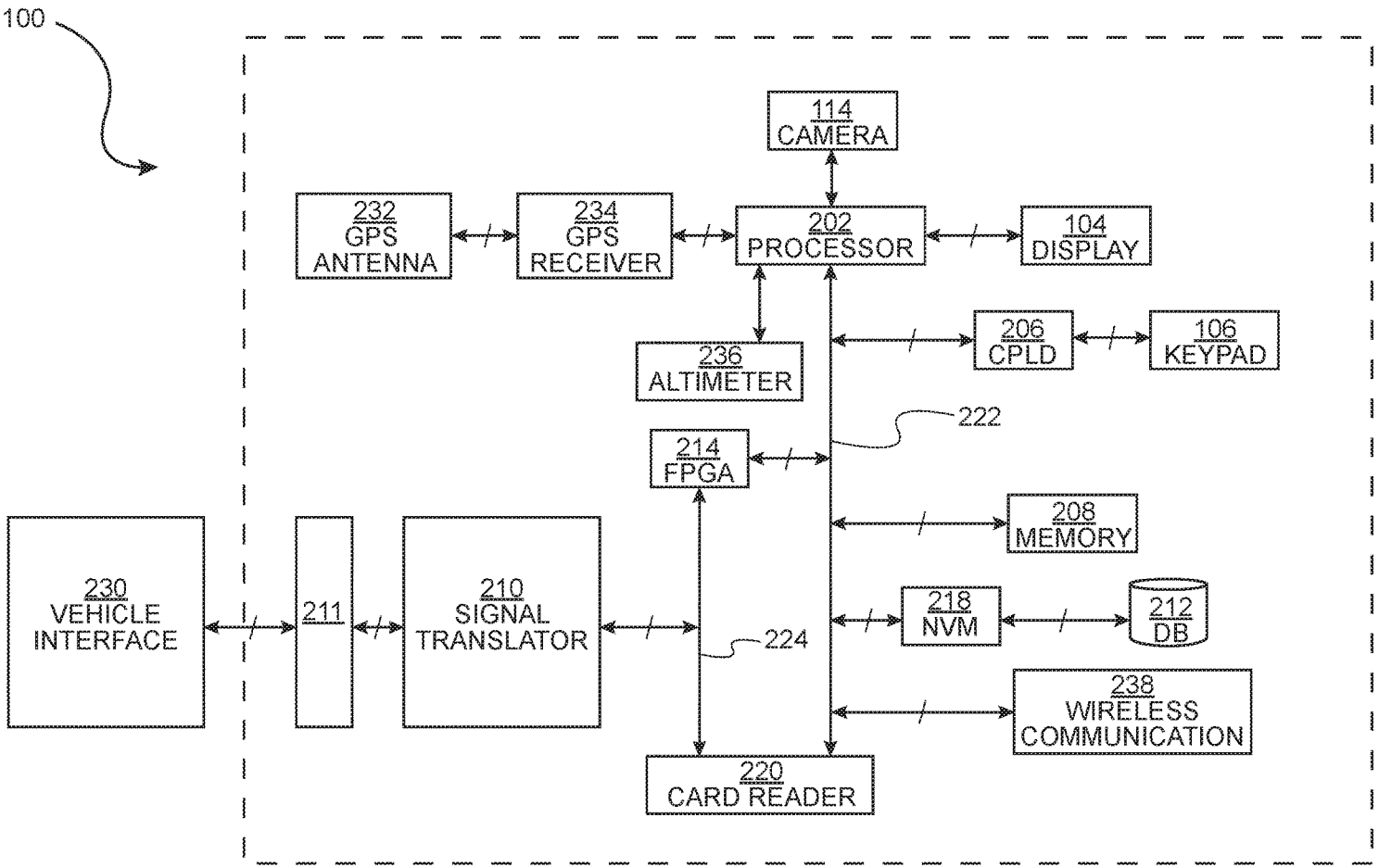
FIG. 2 is a block diagram of the components of the diagnostic tool of FIG. 1 according to an embodiment of the disclosure.

FIG. 2 is a block diagram of the components of the diagnostic tool 100 of FIG. 1 according to an embodiment of the disclosure. In FIG. 2, the diagnostic tool 100 according to an embodiment of the disclosure may include a camera 114, a processor 202, a field programmable gate array (FPGA) 214, a first system bus 224, the display 104, a complex programmable logic device (CPLD) 206, the input device 106 or function button, a memory 208, an internal non-volatile memory (NVM) 218 is a special diagnostic memory having a database 212 with software program and vehicle diagnostic information such as a vehicle diagnostic software, a card reader 220, a second system bus 222, a connector interface 211, a selectable signal translator 210, a GPS antenna 232, a GPS receiver 234, an optional altimeter 236, and a wireless communication circuit 238.

In one embodiment, the wireless communication circuit 238 can be configured to communicate wirelessly with a vehicle communication interface (not shown) that is coupled to the vehicle's interface (not shown) or another remote device. The vehicle communication interface sends signals and vehicle data received from the various electronic control units (ECUs) or engine systems in the vehicle to the wireless communication circuit 238. Wireless communication circuit 238 communicates with the processor 202 via the second system bus 222. The wireless communication circuit 238 can be configured to communicate via RF (radio frequency), satellites, cellular phones (analog or digital), Bluetooth®, Wi-Fi, Infrared, ZigBee, Local Area Networks (LAN), WLAN (Wireless Local Area Network), NFC (near field communication), other wireless communication configurations and standards, or a combination thereof. The wireless communication circuit 238 allows the diagnostic tool 100 to communicate with other devices wirelessly such as with a remote computing device (not shown) having remote databases. The wireless communication circuit 238 includes an antenna or transceiver built therein (not shown) and being housed within the housing 102 or can be externally located on the housing 102.

Signal translator 210 conditions signals received from an ECU unit through the wireless communication circuit 238 or through the connector interface 211 to a conditioned signal compatible with diagnostic tool 100. Signal translator 210 can communicate with, for example, the following communication protocols: J1850 (VPM and PWM), ISO 9141-2 signal, communication collision detection (CCD) (e.g., Chrysler collision detection), data communication links (DCL), serial communication interface (SCI), Controller Area Network (CAN), Keyword 2000(ISO 14230-4), OBD II or other communication protocols that are implemented in a vehicle.

The circuitry to translate and send in a particular communication protocol can be selected by FPGA 214 (e.g., by tri-stating unused transceivers). Signal translator 210 may be also coupled to FPGA 214 and the card reader 220 via the first system bus 224. FPGA 214 transmits to and receives signals (i.e., messages) from the ECU unit through signal translator 210 and the wireless communication circuit 238.

The FPGA 214 may be coupled to the processor 202 through various address, data and control lines by the second system bus 222. FPGA 214 is also coupled to the card reader 220 through the first system bus 224. The processor 202 may also be coupled to the display 104 in order to output the desired information to the user. The processor 202 communicates with the CPLD 206 through the second system bus 222. Additionally, the processor 202 may be programmed to receive input from the user through the input device 106 via the CPLD 206 or via the touchscreen display 104. The CPLD 206 may provide logic for decoding various inputs from the user of the diagnostic tool 100 and also provides glue-logic for various other interfacing tasks.

The processor 202 is a special processor or a diagnostic processor that configured to retrieve diagnostic information from a vehicle's ECU. The processor can be adapted to retrieve and process mode 6 information from the vehicle's OBD II in order to retrieve "misfire" data and display it in a graphical format for the user.

Memory 208 and internal non-volatile memory 218 may be coupled to the second system bus 222, which allows for communication with the processor 202 and FPGA 214. Memory 208 can include an application dependent amount of dynamic random access memory (DRAM), a hard drive, and/or read only memory (ROM). Software to run the diagnostic tool 100 including the GUI can be stored in the memory 208 or 218, including any other database. The diagnostic software includes instructions so that the processor 202 can retrieve mode 6 data from the vehicle's OBD II continuously and dynamically and display it in a graphical format such as a GUI on a display of the diagnostic tool. The database 212 can include diagnostic information and other information related to vehicles.

Internal non-volatile memory 218 can be an electrically erasable programmable read-only memory (EEPROM), flash ROM, or other similar memory. Internal non-volatile memory 218 can provide, for example, storage for boot code, self-diagnostics, various drivers, and space for FPGA images, if desired. Additionally, the internal non-volatile memory 218 may also include software such as a graphics module for rendering and displaying graphics (e.g. icons or modules) on the touchscreen display 104. If less than all of the modules are implemented in FPGA 214, memory 218 can contain downloadable images so that FPGA 214 can be reconfigured for a different group of communication protocols.

A GPS antenna 232 and GPS receiver 234 can be included and may be mounted in or on the housing 102 or any combination thereof. The GPS antenna 232 electronically couples to the GPS receiver 234 and allows the GPS receiver to communicate (detects and decodes signals) with various satellites that orbit the Earth. In one embodiment, the GPS antenna 232 and GPS receiver 234 are one device instead of two. The GPS receiver 234 and GPS antenna 232 may electronically couple to the processor 202, which may be coupled to memory 208, 218 or a memory card in the card reader 220. The memories can be used to store cartographic data, such as electronic maps. The diagnostic tool can include all the maps for the U.S. (or country of use), North America, or can have the region or state where the diagnostic tool is located. In alternative embodiments, the diagnostic tool can have all the maps of the world or any portion of the world desired by the user. This allows the diagnostic tool to be a GPS device so that a driver can drive from one location to another. The maps may be overlay or may incorporate traffic, local events, and location of other GPS devices (smart phones), and other information that can be useful to the technician. By being able to locate other diagnostic tools with GPS, then the technicians may be able to use the diagnostic tools to locate each other in order to conduct a meeting or have a social event.

The GPS receiver communicates with and "locks on" to a certain number of satellites in order to have a "fix" on its global location. Once the location is fixed, the GPS receiver, with the help of the processor, can determine the exact location including longitude, latitude, altitude, velocity of movement, and other navigational data of the diagnostic tool 100.

Should the GPS receiver be unable to lock onto the minimum number of satellites to determine the altitude or unable to determine the altitude for any reason, the altimeter 236 can be used to determine the altitude of the diagnostic tool 100. The altimeter 236 is electronically coupled to the processor 202 and can provide the altitude or elevation of the diagnostic tool 100. The altimeter 236 can be coupled to a barometric pressure sensor (not shown) in order to calibrate the elevation measurements determined by the altimeter. The sensor can be positioned interior or exterior to the housing 102 of the diagnostic tool 100. Minor atmospheric pressure changes can affect the accuracy of the altimeter 236, thus, diagnostic tool can correct for these changes by using the sensor in conjunction with the altimeter 236 along with a correction factor known in the art.

In an alternative embodiment, a vehicle communication interface 230 of the vehicle under test is in communication with the diagnostic tool 100 through connector interface 211 via an external cable (not shown). Selectable signal translator communicates with the vehicle communication interface 230 through the connector interface 211.

Figure 3:
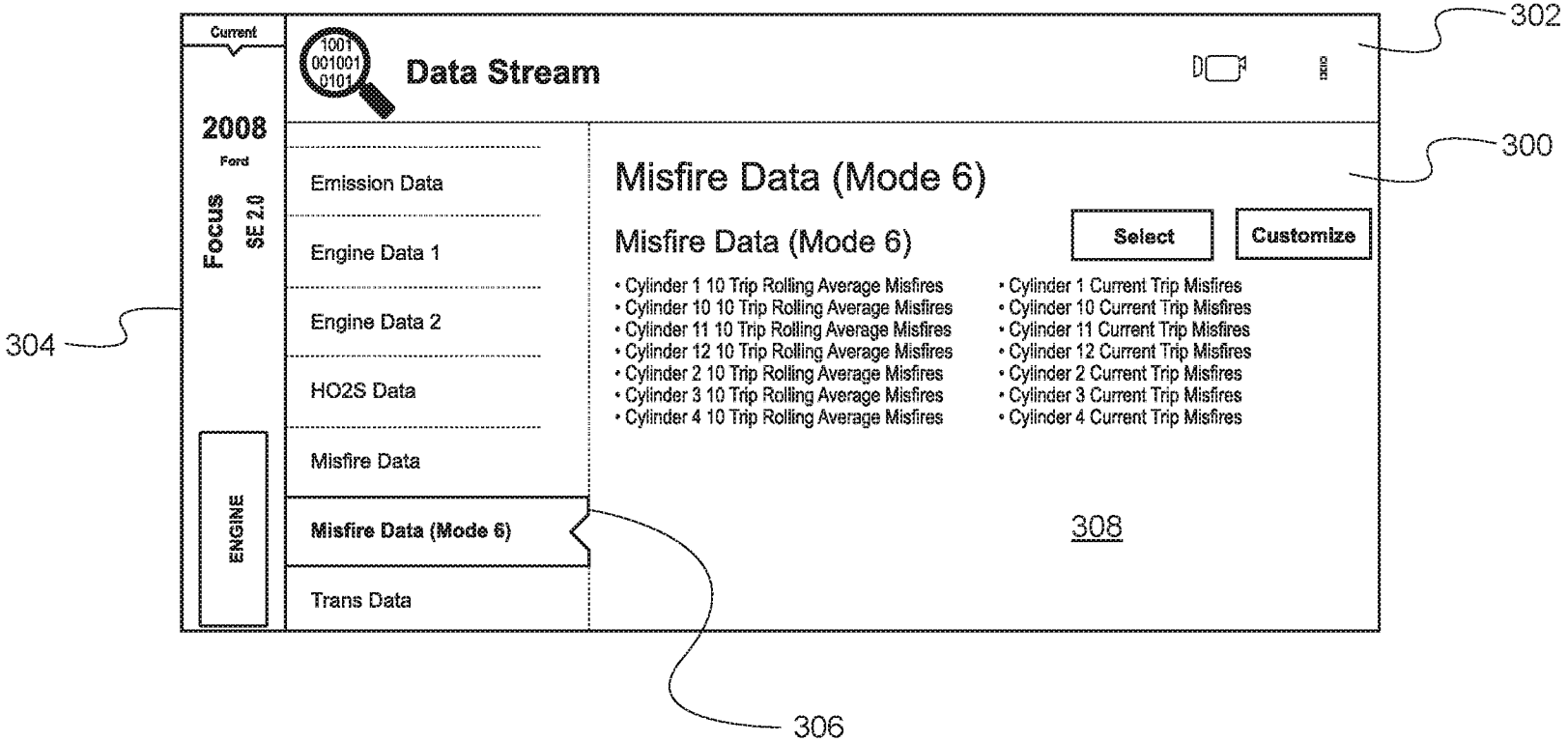
FIG. 3 illustrates an exemplary graphical user interface (GUI) according to an embodiment of the disclosure.

FIG. 3 illustrates an exemplary graphical user interface (GUI) 300 according to an embodiment of the disclosure. The GUI 300 may include various icons, information banner, modules, interface elements, and the like. The icons or modules may be activated by touching with a finger or a stylus and the like on the display 104 or through the user interface 106. The display 104 can be touch sensitive and is able to interpret finger contacts, finger tap gestures, finger swipe gestures, stylus movements, any combination thereof, and the like. It should be understood that, in some embodiments, one or more of the finger inputs are replaced with input from another input device (e.g., a mouse based input or stylus input). For example, a swipe gesture may be replaced with a mouse click (e.g., instead of a contact) followed by movement of the cursor along the path of the swipe (e.g., instead of movement of the contact). A further embodiment, a tap gesture may be replaced with a mouse click while the cursor is located over the location of the tap gesture (e.g., instead of detection of the contact followed by ceasing to detect the contact). Similarly, when multiple user inputs are simultaneously detected, it should be understood that multiple computer mice may be used simultaneously, or a mouse and finger contacts may be used simultaneously.

GUI 300 includes a title banner 302, a vehicle information banner 304, and icons or modules 306 and viewing panel 308. In this example, title banner 302 displays the title or subject matter of the GUI 300. In this case, the title banner 302 is "data stream" for misfire data (mode 6) from a vehicle. In this case, the vehicle information banner 304 identifies the vehicle as a 2008 Ford Focus SE 2.0., which has four cylinders in the base model. However, the panel 308 displays a default of misfire data for a 12 cylinder vehicle as consumer vehicles, at most, include 12 cylinders.

As shown in the panel 308 information regarding each cylinder may contain either trip rolling average misfires or current trip misfires. Although these are examples of the type of counts for misfires, other categories of misfires may be utilized, such as misfires in the last trip, three trips, five trips, ten trips and the like. Under the category of current trip misfires, this means the number of misfires by the particular cylinder (e.g. cylinder number three) during the current trip. Under the category of trip rolling average, this means the number of misfires by the particular cylinder after an event. The event may be any event including the last time the relevant misfire DTC (diagnostic trouble code) was reset, the last time that particular cylinder had a misfire, or a particular date such as when the cylinder was repaired and the like. The rolling average may also be based on a certain number of misfires such as three, five, seven and the like.

In one embodiment, once the rolling average hits the number of misfires that are set by the user such as three misfires after an event, then the diagnostic tool through the processor 202 can alert the user via email, text message, phone, or message on the display of the scan tool. Additionally, in another embodiment, once the rolling average of the misfire has hit the predetermined number set by the user, then the wireless communication interface may launch a web browser on the display of the diagnostic tool or on a remote computing device such as the owner of the vehicle or a repair facility so that the vehicle can be scheduled for repairs. The repair facility may be the facility that the vehicle is currently in or another facility chosen by the vehicle owner.

Figure 4:
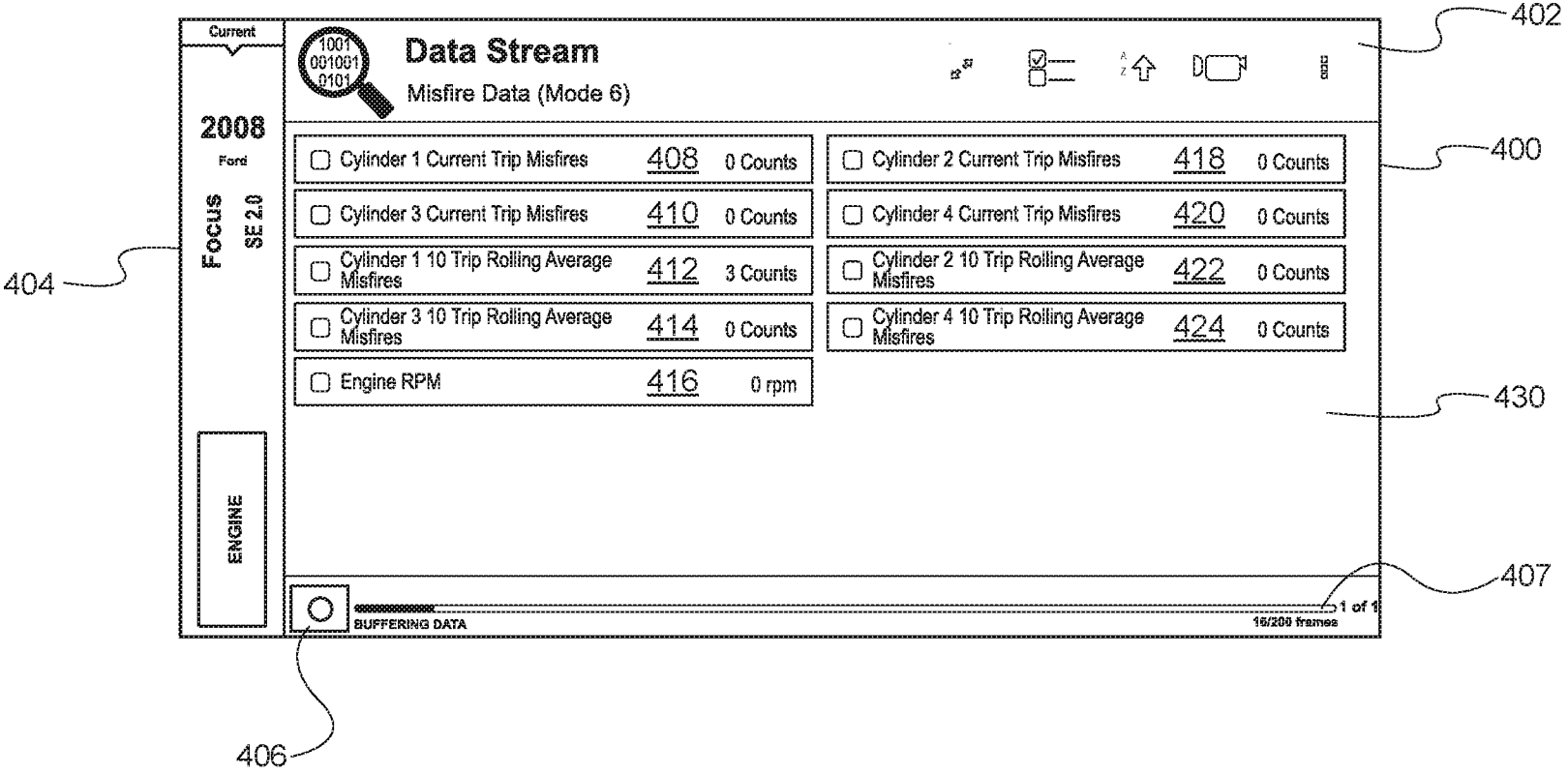
FIG. 4 illustrates another exemplary GUI according to another embodiment of the disclosure.

FIG. 4 illustrates an exemplary GUI 400 according to another embodiment of the invention. The GUI 400 may be obtained by following the flowchart shown in FIG. 5, as described below. The GUI 400 may include various icons, information banner, modules, interface elements, and the like. In one embodiment, the GUI 400 includes a title banner 402, which is the title of the subject matter of GUI 400. In this case, the title banner 402 includes "data stream" and "misfire data (mode 6)." Vehicle information banner 404 shows the same vehicle as in vehicle information banner 304 in FIG. 3. Additionally GUI 400 includes icons or modules 408-424 and a viewing panel 430.

Also shown in GUI 400 is data record button 406 that controls a data recording line 407. Once activated, for example, via being pressed, the data record button will start recording data for the various cylinders in the vehicle under test for misfires. The recorded data may include cylinder misfires via mode 6, other vehicle diagnostic data such as engine rpm, mass airflow, data from throttle position sensor or $O_2$ sensor for comparison.

Modules 408-424 illustrate information related to the data stream such as cylinder misfires and rpm. Specifically, module 408 illustrates information of cylinder 1 including the current trip misfires and the number of counts (zero counts). The counts mean the number of time the misfire has occurred based on the criteria for that relevant module. Module 410 illustrates information of cylinder 3 including current trip misfires and the number of counts (zero counts). Module 412 illustrates information of cylinder 1 including current 10 trip rolling averages misfires and the number of counts is three. In this case, 10 trip rolling averages misfires mean that the module is counting the average number of misfires that has occurred during the most recent 10 trips, which was 3 times (while module 408 shows that no misfires has occurred during the current trip). Module 414 illustrates information of cylinder 3 including current 10 trip rolling averages misfires and the number of counts (zero counts).

Module 416 illustrates the engine rpm being data streamed. This information can be used along with the other modules 408-424 to diagnose the vehicle such as by comparing modules' data. That is the technician can confirm issue with the misfires because the engine RPM are not reading as being within a predefined "normal" parameter for the vehicle under test when all cylinders are properly firing. In other words, the engine rpm is lower than what is expected to be "normal" when one or cylinders is misfiring as indicated by the other modules. Module 418 illustrates information of cylinder 2 including the current trip misfires and the number of counts (zero counts). Similarly, module 420 illustrates information of cylinder 4 including the current trip misfires and the number of counts (zero counts). Module 422 illustrates information of cylinder 2 including current 10 trip rolling averages misfires and the number of counts (zero counts). Module 424 illustrates information of cylinder 3 including current 10 trip rolling averages misfires and the number of counts (zero counts). It should be noted, that the modules related to cylinder misfires (not 416) have been reduced in GUI 400 from those shown in GUI 300 to show only the number cylinders that are associated with the 2008 Ford Focus SE 2.0. (i.e. 4 cylinders). However in other embodiments, any number cylinders may be shown ranging, for example, from 1 to 12 cylinders or more.

Figure 5:
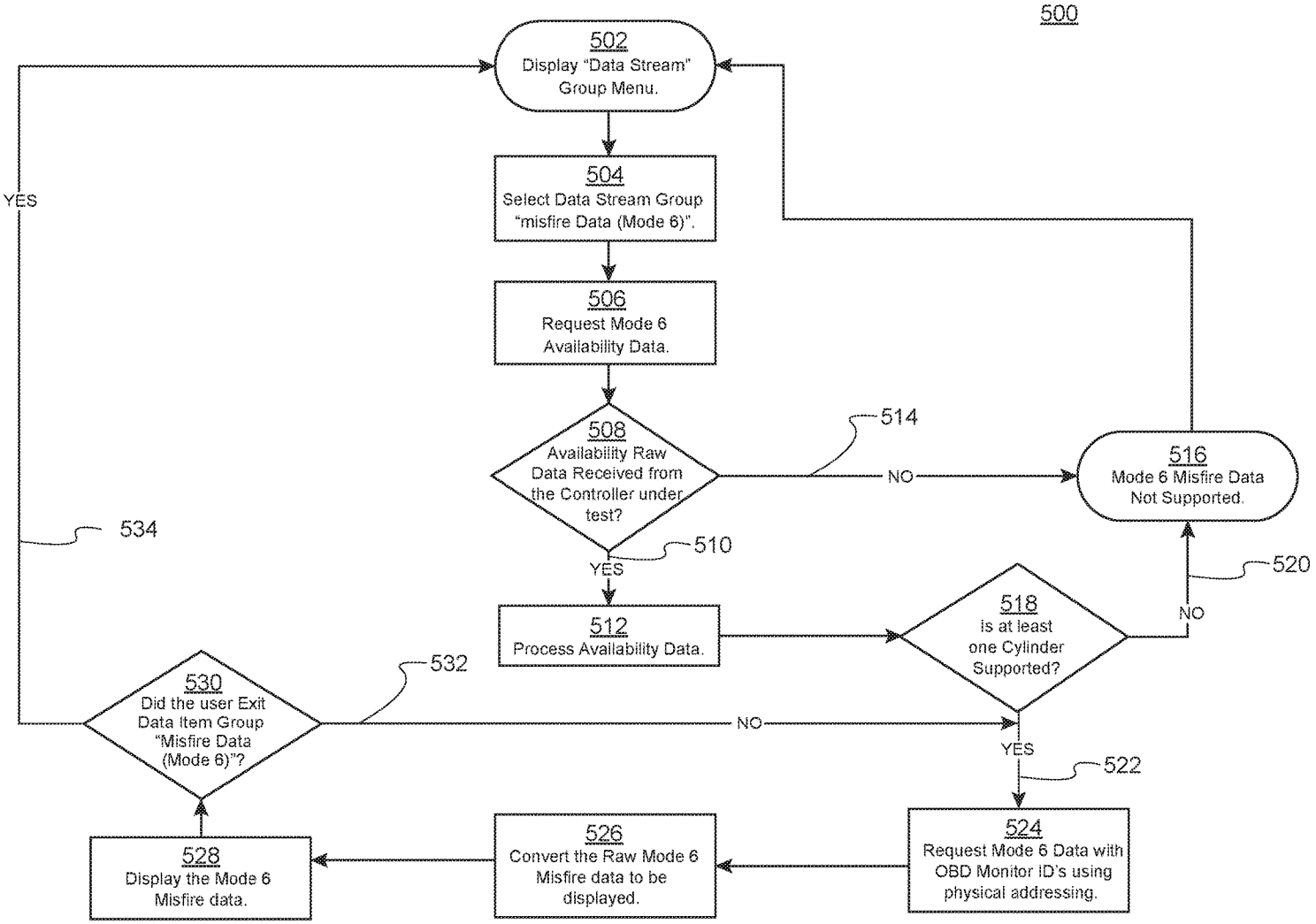
FIG. 5 illustrates a method to display misfire data according to an embodiment of the disclosure.

FIG. 5 illustrates a method to display misfire data 500 according to an embodiment of the invention. At step 502, a computing device such as a diagnostic tool having a display can display the "Data Stream" group menu for selection by the user. As shown for example in GUI 300. At step 504, the diagnostic tool receives a selection of data stream group "misfire data (mode 6)" 306 from the "Data Stream" group menu of GUI 300. The selection may be done by the user using his finger on the touchscreen or a stylus and the like. At step 506, the diagnostic tool requests mode 6 availability data with OBD monitor ID 0xA0 using physical addressing Ox7E0 . That is, this query uses physical addressing Ox7E0 to allow the diagnostic tool to receive diagnostic information from only the engine (powertrain) controller in the vehicle instead of the other controllers that are available under a mode 6 query. In one embodiment, the transmit buffer will include Ox70, 0xE0 , Ox06 , OxA0 . In general, AO is the OBD monitor IDs that may be supported. For example, if the vehicle has 12 cylinders then A2 is for "misfire cylinder 1 data," A3 is for "misfire cylinder 2 data," A4 is for "misfire cylinder 3 data," A5 is for "misfire cylinder 4 data," A6 is for "misfire cylinder 5 data," A7 is for "misfire cylinder 6 data," A8 is for "misfire cylinder 7 data," A9 is for "misfire cylinder 8 data," AA is for "misfire cylinder 9 data," AB is for "misfire cylinder 10 data," AC is for "misfire cylinder 11 data," and AD is for "misfire cylinder 12 data." At step 508, does the engine controller under test return raw data such as a bit? If yes 510 or the cylinder data is available for that cylinder, a bit is set, and at step 512, the diagnostic tool processes the availability data, and thus knows the number of cylinders that are in the vehicle under test based on the number of returned bits. If no 514, and then proceed to step 516 and the diagnostic tool concludes that mode 6 misfire data is not supported and the process proceeds back to step 502 for the user to start again.

At step 518, the diagnostic tool determines if at least one cylinder is supported as determined by the process of step 512. If no 520, then the process proceeds to 516 and then back to 502. If yes 522, then at step 524 request mode 6 data with OBD monitor IDs using physical addressing for the engine controller. At step 526, the diagnostic tool converts the raw mode 6 misfire data for display on the display of the diagnostic tool. At step 528, the diagnostic tool displays the mode 6 misfire data similar to what is shown in GUI 400 and modules 408-424. At step 530, the diagnostic tool determines if the user wants to exit (by hitting the back button or escape button, for example) data item group "misfire data (mode 6)?" If yes 534, then proceed back to step 502. If no 532, then proceed to step 524 in order to continue to request mode 6 data with OBD monitor IDs using physical addressing. This is where the diagnostic tool can receive the mode 6 live stream misfire data on a continuous and dynamic basis instead of only a snapshot of the mode 6 misfire data. In addition to misfire data, other mode 6 data such as RPM, position throttle sensor, $O_2$ sensor, and/or mass airflow can be continuously receive via a live stream. By having these additional mode 6 live stream data to compare against the cylinder misfire data, the technician can make a more accurate diagnosis of the misfire. For example, if the RPM is lower than expected, then this can confirm that at least one or more cylinders is misfiring.

As shown herein, a process is provided that allows for use in vehicles that no longer support forms of live data using proprietary enhanced queries such as a FORD with CAN. By using a physical address for a particular engine controller, information from that controller can be supplied to the diagnostic tool. Further, because physical address is used for the ECU that the technician wants then information from other ECUs are not providing unwanted information and thus the relevant information is displayed faster than the conventional methods. Further, the method disclosed herein allows for a more accurate diagnosis as continuous and dynamic updating of mode 6 misfire data is constantly shown and recorded instead of the conventional snapshot. Further, reliance on set DTC to detect a misfire is no longer required with the embodiments of the current disclosure.

It should also be noted that the software implementations, such as the GUI of the disclosure as described herein can be stored on a tangible, non-transitory storage medium, such as: a magnetic medium such as a disk or tape; a magneto-optical or optical medium such as a compact disc or digital video disc; or a solid state medium such as a memory card or other package that houses one or more read-only (non-volatile) memories, random access memories, or other re-writable (volatile) memories. Accordingly, the disclosure is considered to include a tangible storage medium or distribution medium, as listed herein and including art-recognized equivalents and successor media, in which the software implementations comprising code segments are stored. Additionally, although a diagnostic tool is described herein, the disclosure may be implemented on any computing device (having a processor and a memory) such as a personal computer, notebook, smart phone, a tablet and the like.

The many features and advantages of the disclosure are apparent from the detailed specification, and thus, it is intended by the appended claims to cover all such features and advantages of the disclosure, which fall within the true spirit, and scope of the disclosure. Further, since numerous modifications and variations will readily occur to those skilled in the art, it is not desired to limit the disclosure to the exact construction and operation illustrated and described, and accordingly, all suitable modifications and equivalents may be resorted to, falling within the scope of the disclosure.

What is claimed is:

1. A vehicle diagnostic tool, comprising:

a diagnostic processor configured to execute non-transitory computing instructions;

a connector interface configured to connect with a connector in a vehicle and retrieve vehicle diagnostic data from the vehicle with the processor, wherein the vehicle diagnostic data is mode 6 cylinder misfire data;

a display in communication with the processor configured to display vehicle diagnostic data;

a wireless communication interface in communication with the processor and configured to communicate with a remote device having a vehicle diagnostic database; and a memory in communication with the processor, the memory containing the non-transitory computing instructions, that when executed by the processor causes the processor to:

retrieve the vehicle diagnostic data including diagnostic trouble codes (DTCs) and the mode 6 cylinder misfire data, the mode 6 cylinder misfire data is retrieved continuously and dynamically by using physical addressing of an engine controller in the vehicle;

generate, on the display, a plurality of selectable icons corresponding to individual cylinder misfire data for each supported cylinder of the vehicle;

indicate on the selectable icons an index number of a cylinder that is misfiring, if any, for each supported cylinder; and activate a web browser on the remote device to start a repair process.

2. The diagnostic tool of claim 1, wherein indicating on the selectable icons the index number of the cylinder that is misfiring for a current trip driven by an operator.

3. The diagnostic tool of claim 1, wherein indicating on the selectable icons the index number of the cylinder that is misfiring for a predetermined trip rolling average misfires.

4. The diagnostic tool of claim 1, wherein the processor further retrieves other mode 6 data that includes engine RPM data, positon throttle sensor data, $O_2$ sensor data, or mass airflow data.

5. The diagnostic tool of claim 4, wherein the processor further compares with the processor the other mode 6 data with the mode 6 cylinder misfire data to verify a misfire in a cylinder.

6. The diagnostic tool of claim 1, wherein the processor further determines if at least one cylinder of the vehicle is supported based on whether a data bit is set for the at least one cylinder.

7. The diagnostic tool of claim 1, wherein the processor further requests mode 6 data availability with OBD monitor ID using physical addressing of the engine controller.

8. A non-transitory machine-readable storage medium comprising machine-readable instructions for causing a processor of a diagnostic tool to execute the method of:

retrieving vehicle diagnostic data including diagnostic trouble codes (DTCs) and mode 6 cylinder misfire data, the mode 6 cylinder misfire data is retrieved continuously and dynamically by using physical addressing of an engine controller in the vehicle;

generating, on a display of the diagnostic tool, a plurality of selectable icons corresponding to individual cylinder misfire data for each supported cylinder of the vehicle;

indicating on the selectable icons an index number of a cylinder that is misfiring, if any, for each supported cylinder; and activating a web browser on a remote device to start a repair process.

9. The non-transitory machine-readable storage medium of claim 8, wherein indicating on the selectable icons the index number of the cylinder that is misfiring is for a current trip driven by an operator.

10. The non-transitory machine-readable storage medium of claim 8, wherein indicating on the selectable icons the index number of the cylinder that is misfiring for a predetermined trip rolling average misfires.

11. The non-transitory machine-readable storage medium of claim 10, wherein the predetermined trip rolling average misfires is 3 or 10.

12. The non-transitory machine-readable storage medium of claim 8, wherein the processor is further caused to retrieve other mode 6 data that includes engine RPM data, positon throttle sensor data, $O_2$ sensor data, or mass airflow data.

13. The non-transitory machine-readable storage medium of claim 12, wherein the processor is further caused to compare the other mode 6 data with the mode 6 cylinder misfire data to verify a misfire in a cylinder.

14. The non-transitory machine-readable storage medium of claim 8, wherein the processor is further caused to request mode 6 data availability with OBD monitor ID using physical addressing of the engine controller.

15. A vehicle diagnostic tool, comprising:

means for processing configured to execute non-transitory computing instructions;

means for interfacing configured to connect with a connector in a vehicle and retrieve vehicle diagnostic data from the vehicle with the means for processing, wherein the vehicle diagnostic data is mode 6 cylinder misfire data;

means for displaying in communication with the means for processing configured to display the vehicle diagnostic data;

means for wireless communication in communication with the means for processing and configured to communicate with a remote device having a vehicle diagnostic database; and means for storing in communication with the means for processing, the means for storing containing the non-transitory computing instructions, that when executed by the means for processing causes the means for processing to:

retrieve the vehicle diagnostic data including diagnostic trouble codes (DTCs) and the mode 6 cylinder misfire data, the mode 6 cylinder misfire data is retrieved continuously and dynamically by using physical addressing of an engine controller in the vehicle;

generate, on the means for displaying, a plurality of selectable icons corresponding to individual cylinder misfire data for each supported cylinder of the vehicle;

indicate on the selectable icons an index number of a cylinder that is misfiring, if any, for each supported cylinder; and activate a web browser on the remote device to start a repair process.

16. The diagnostic tool of claim 15, wherein indicating on the selectable icons the index number of the cylinder that is misfiring is for a current trip driven by an operator.

17. The diagnostic tool of claim 15, wherein indicating on the selectable icons the index number of the cylinder that is misfiring is for a predetermined trip rolling average misfires.

18. The diagnostic tool of claim 15, wherein the means for processing is further caused to retrieve other mode 6 data that includes engine RPM data, positon throttle sensor data, $O_2$ sensor data, or mass airflow data.

19. The diagnostic tool of claim 18, wherein the means for processing is further caused to compare the other mode 6 data with the mode 6 cylinder misfire data to verify a misfire in a cylinder.

20. The diagnostic tool of claim 15, wherein the means for processing is further caused to request mode 6 data availability with OBD monitor ID using physical addressing of the engine controller.

* * * * *